US011525263B2

(12) United States Patent
Chiang et al.

(10) Patent No.: US 11,525,263 B2
(45) Date of Patent: Dec. 13, 2022

(54) COMBINED STRUCTURE OF THE COMBINED BUNDLE OF COLUMNS IN THE COLUMN

(71) Applicants: Wen-Tsai Chiang, Taipei (TW); Keng-Chang Chiu, Taipei (TW); Che-Sheng Chen, Taoyuan (TW)

(72) Inventors: Wen-Tsai Chiang, Taipei (TW); Keng-Chang Chiu, Taipei (TW); Che-Sheng Chen, Taoyuan (TW)

( * ) Notice: Subject to any disclaimer, the term of this patent is extended or adjusted under 35 U.S.C. 154(b) by 0 days.

(21) Appl. No.: 17/372,574

(22) Filed: Jul. 12, 2021

(65) Prior Publication Data

US 2022/0056694 A1 Feb. 24, 2022

(30) Foreign Application Priority Data

Aug. 24, 2020 (TW) ..... 109128761

(51) Int. Cl.
*E04C 5/16* (2006.01)
*E04C 3/34* (2006.01)

(52) U.S. Cl.
CPC ..... *E04C 5/166* (2013.01); *E04C 3/34* (2013.01)

(58) Field of Classification Search
CPC ..... E04C 5/166; E04C 3/34; E04C 5/0604; E04C 5/06; E04C 5/0613; E04C 5/0609
See application file for complete search history.

(56) References Cited

U.S. PATENT DOCUMENTS 6,293,071 B1 * 9/2001 Konstantinidis ..... E04C 5/02 52/659
10,584,492 B2 * 3/2020 Chuang ..... E04C 5/166

FOREIGN PATENT DOCUMENTS

| | | | | |
|---|---|---|---|---|
| CN | 205653982 U | | 10/2016 | |
| DE | 10324291 A1 | * | 12/2004 | ..... E04B 5/43 |
| FR | 2267432 A1 | * | 11/1975 | |
| JP | S6145050 A | | 3/1986 | |
| JP | S61113947 A | | 5/1986 | |
| JP | H0578742 U | | 10/1993 | |
| JP | H09119184 A | | 5/1997 | |
| JP | 10231585 A | * | 9/1998 | |
| JP | 2019120118 A | | 7/2019 | |
| TW | M458425 U | | 8/2013 | |
| TW | 201610271 A | | 3/2016 | |
| TW | 201930699 A | | 8/2019 | |
| WO | WO-2006079639 A1 | * | 8/2006 | ..... E04C 5/0604 |

* cited by examiner

*Primary Examiner* — Adriana Figueroa
(74) *Attorney, Agent, or Firm* — Bacon & Thomas, PLLC

(57) ABSTRACT

A combined structure of a column includes a plurality of main steel bars, a consecutive stirrup, and a plurality of tie bars. The plural main steel bars are arrayed to form an inner confined region and an outer confined region surrounding the inner confined region. Further, the consecutive stirrup proceeds with a consecutive turning and surrounding along the inner confined region and the outer confined region, and surrounds a region in the consecutive stirrup of the inner confined region so as to form a column core. As such, a complete confinement can be provided for the main steel bars, so as to effectively prevent the main steel bars from buckling, such that the performance of seismic resistance for the columns can be enhanced.

10 Claims, 11 Drawing Sheets

COMBINED STRUCTURE OF THE COMBINED BUNDLE OF COLUMNS IN THE COLUMN

BACKGROUND OF THE INVENTION

1. Field of the Invention

The present invention relates to a combined structure in a column, and more particularly, to a combined structure in a column adapted for avoiding buckling of main steel bars, and for enhancing the performance of seismic resistance for columns.

2. Description of Related Art

Buildings rely on the framework of column girders as a primary supporting structure, where the column girders bear the function of support by grouting into beams or columns in which a plurality of steel cages are arranged. In particular, Taiwan is located in the circum-Pacific seismic belt, one of the regions that earthquakes occur most frequently in the world. In accordance with the building acts or regulations, all the structures require designs on seismic resistance, such designs demand specifically a certain degree of seismic resistance for the beams or columns of buildings.

Further, as far as seismic resistance for the column members of steel concrete of buildings is concerned, the known methods for binding stirrups or tie bars are always restricted by construction environment or construction accuracy, such that construction quality control becomes difficult, and this always results in a poor confinement effect for the steel concrete. When subject to a great axial force and bending moment, the main steel bars will be buckled and break out, so as to squeeze and peel off the concrete surrounding the columns. This will break out the stirrups surrounding the columns, and decrease rapidly the strength of column members, so as to greatly reduce the safety of the structure of buildings.

References are made to FIG. 1, a perspective view illustrating a conventional combined structure of main steel bars, stirrups and tie bars; and FIG. 2, a plan view illustrating the conventional combined structure of main steel bars, stirrups and tie bars, as shown in FIG. 1. For a construction work, in order to stabilize a plurality of longitudinal main steel bars 91, prior to grouting concrete 90 for a grouting work in constructing beams and columns, it is necessary to arrange stirrup structures of multiple layers at various levels.

Currently for mesh-like stirrup structures composed of longitudinal main steel bars 91, stirrups 92 are bended and surround the longitudinal main steel bars 91, then a plurality of lateral tie bars 93 are staggered and laid on the stirrups 92, such that the tie bars 93 are each having their two ends hooked in between the longitudinal main steel bars 91 so as to form a planar stirrup structure. As shown in FIG. 2, the tie bars 93 each have their first end 931 bended as a hook of 90°, and each have their second end 932 bended as a hook of 135°.

During a construction work, a constructer needs to lay inclinedly the second end 932 of the tie bar 93 and to clamp one of the longitudinal main steel bars 91, and then lay in position to hook the longitudinal main steel bar of opposite side. Namely, the tie bar 93 has its first end 931 and second end 932 join fixedly the opposite corresponding longitudinal main steel bars 91. Then the work is repeatedly performed so as to fix the corresponding longitudinal main steel bars 91 until the fixing work of a stirrup structure at a level is completed.

After the work of fixing a stirrup structure at a level has been finished, then repeating the aforesaid working step to construct the stirrup structure at other heights of the plural longitudinal main steel bars 91, until then the work of fixing the overall stirrup structure can be completed, and thereafter the work of grouting can be performed.

In view of the fact that for various architectural engineering, the required structure, strength, length, diameter, or specification varies, making it impossible for the stirrup structure to have a unified specification and so a preproduction thereof becomes impossible. Besides, the completion of a stirrup structure includes stirrups 92, plural longitudinal and lateral tie bars 93, and eventually an implant fixation by metal wires is performed so as to complete a staggered mesh-like or a ⊞-like stirrup structure. Obviously, such working process consumes a great deal of labor to perform cutting, bending and node fixing for the tie bars 93 of various lengths and forms. This, however, incurs miscellaneous problems easily, such as preparation, temporary storage, and the number of components to be balanced, and most importantly, the quality of engineering is worrying.

Now referring to FIG. 3, a plan view illustrating the conventional combined structure of main steel bars, stirrups and tie bars in a dual-core seismic resistance columns, such structure is disclosed in Taiwan Utility Model Patent Publication No. M 458425, and relates to a "Combined Structure of Dual-Core Seismic Resistance Column Steel Bars," namely, a plurality of longitudinal main steel bars 81 are arrayed to form an inner confined region 82 and an outer confined region 83 surrounding the inner confined region 82. Further, a stirrup 84 proceeds with a consecutive turning and surrounding so as to form a structure surrounding the inner confined region 82 and the outer confined region 83, where an initial section 841 and a terminal section 842 of the stirrup 84 each have an anchoring section. Besides, a plurality of tie bars 85 are provided for connecting the plural longitudinal main steel bars 81 at the outer confined region 83. Such manner, as compared with other conventional manner for binding together stirrup frames and tie bars, not only has a better confinement effect, but also enhances supporting capability for the overall columns, so as to compensate the insufficiency and loss of strength for the columns, because the columns bear a great stress and the concrete wrapping the stirrups of the columns peels off. However, the consecutive stirrups 84 of the dual-core columns in the column, as shown in FIG. 3, fail to confine all the main steel bars in the columns. In other words, there are still many column steel bars 81 in the outer confined region 83 standing in an unconfined status. This will make the unconfined column steel bars buckled easily, as subject to great axial force and repeated displacement, and lead to a rapid decay for the strength and stiffness for the columns.

Further, for the conventional seismic resistance tie bars incorporated with the dual-core columns in the column, one end of the tie bar adopts a confined hook (a 135° hook or a 180° hook), and the other end adopts a common hook (a 90° hook). This, however, makes the 90° hooks of the seismic resistance tie bars flare out, and loses the capability of confinement to the main steel bars, as such, the confinement effect is lost. Moreover, for the conventional seismic resistance tie bars incorporated with the dual-core columns in the column, there is a problem need to be dealt with when in construction, namely the tie bars have a fixed length of bending, however the main steel bars will deviate for some displacement due to the constructional environment. Therefore, in the engineering practice, the seismic resistance tie bars can only have one end 100% hooked on the main steel bars, whereas the other end can hardly be 100% hooked on the main steel bars. As such, the confinement effect thereof cannot be as good as being expected. Further, the recent study shows, as long as the column stress is 30% greater than the concrete pressure resistance, all the main steel bars have to be confined by the confined hooks. However, the conventional seismic resistance tie bars fail to satisfy this requirement.

Given the above, with the spirit of aggressive innovation, a combined structure in a column was conceived for solving the above-mentioned problems, and through persistent research and experiments, the present invention has eventually been accomplished.

SUMMARY OF THE INVENTION

An object of the present invention is to provide a combined structure in a column, characterized by having core columns able to bear great axial tension and pressure, and providing a complete confinement for the main steel bars, so as to effectively prevent the main steel bars from buckling, and to decrease the decay of the strength and stiffness of the columns as subject to great axial force and repeated displacement, such that the performance of seismic resistance for the columns can be enhanced.

Another object of the present invention is to provide a combined structure in a column that the manner of overlapping joining or non-overlapping joining can be performed in the combined structure in a column, or arranged in various angles in the combined structure in a column. As such, a confinement effect can be enhanced for the "columns in the column." This not only makes the construction easier, but also increases flexibility of arrangement without being adversely affected by the deviation of main steel bars at the site.

Still another object of the present invention is to provide a combined structure in a column, so as to overcome the disadvantages inherent in Taiwan Utility Model Patent Publication No. M 458425, entitled "Combined Structure of Dual-Core Seismic Resistance Column Steel Bars." Namely, the second end of a seismic resistance tie bar relates to a common 90° hook, which can hardly achieve the purpose of confinement, and cannot confine the main steel bars. For the conventional seismic resistance tie bars incorporated with the dual-core columns in the column, there is a problem need to be dealt with when in construction, namely the tie bars have a fixed length of bending, however the main steel bars will deviate for some displacement due to the constructional environment. Therefore, in the engineering practice, the seismic resistance tie bars can only have one end 100% hooked on the main steel bars, whereas the other end can hardly be 100% hooked on the main steel bars. As such, the confinement effect thereof cannot be as good as being expected.

To achieve the above-mentioned objects, the combined structure in a column, according to the present invention, comprises a plurality of main steel bars, a consecutive stirrup, and a plurality of tie bars. The plural main steel bars are arrayed to form an inner confined region and an outer confined region surrounding the inner confined region. Further, the consecutive stirrup proceeds with a consecutive turning and surrounding along the inner confined region and the outer confined region, and surrounds a region in the consecutive stirrup of the inner confined region so as to form a column core. The plural tie bars are each connected in between the plural main steel bars in the inner confined region and the outer confined region. The tie bars each include a first end and a second end, where the first end hooks one of the plural main steel bars, which lacks lateral support, in the outer confined region, while the second end anchors in the column core.

According to the present invention, each of the tie bars hooking the outer confined region has its first end formed as a hook greater than 135°. Besides, each of the tie bars anchored in the column core has its second end formed as a hook of any angle, or formed linearly without a hook.

Further, according to the present invention, each of the tie bars anchored in the column core has its second end anchored on the consecutive stirrup, or anchored in the region of the inner confined region.

Still further, according to the present invention, the consecutive stirrup, surrounding the main steel bars in the inner confined region and the outer confined region, may surround every main steel bar or may not surround every main steel bar.

According to the present invention, two of the plural tie bars have their first ends connected with and hooked on, respectively at two opposite sides, two of the plural main steel bars and the consecutive stirrup. Besides, the two tie bars anchored in the column core have their second ends arranged, respectively, in a manner of overlapping joining or non-overlapping joining, and arranged with hooks of any angle or arranged linearly without hooks.

Further, according to the present invention, the tie bars each hooking the outer confined region have their first end tie up one of the plural main steel bars by a winding manner.

Still further, according to the present invention, the tie bars each have their second end anchored in the column core in a manner of non-vertical to the consecutive stirrup. Besides, two of the plural tie bars have their second ends vertically and inclinedly anchored in the column core.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
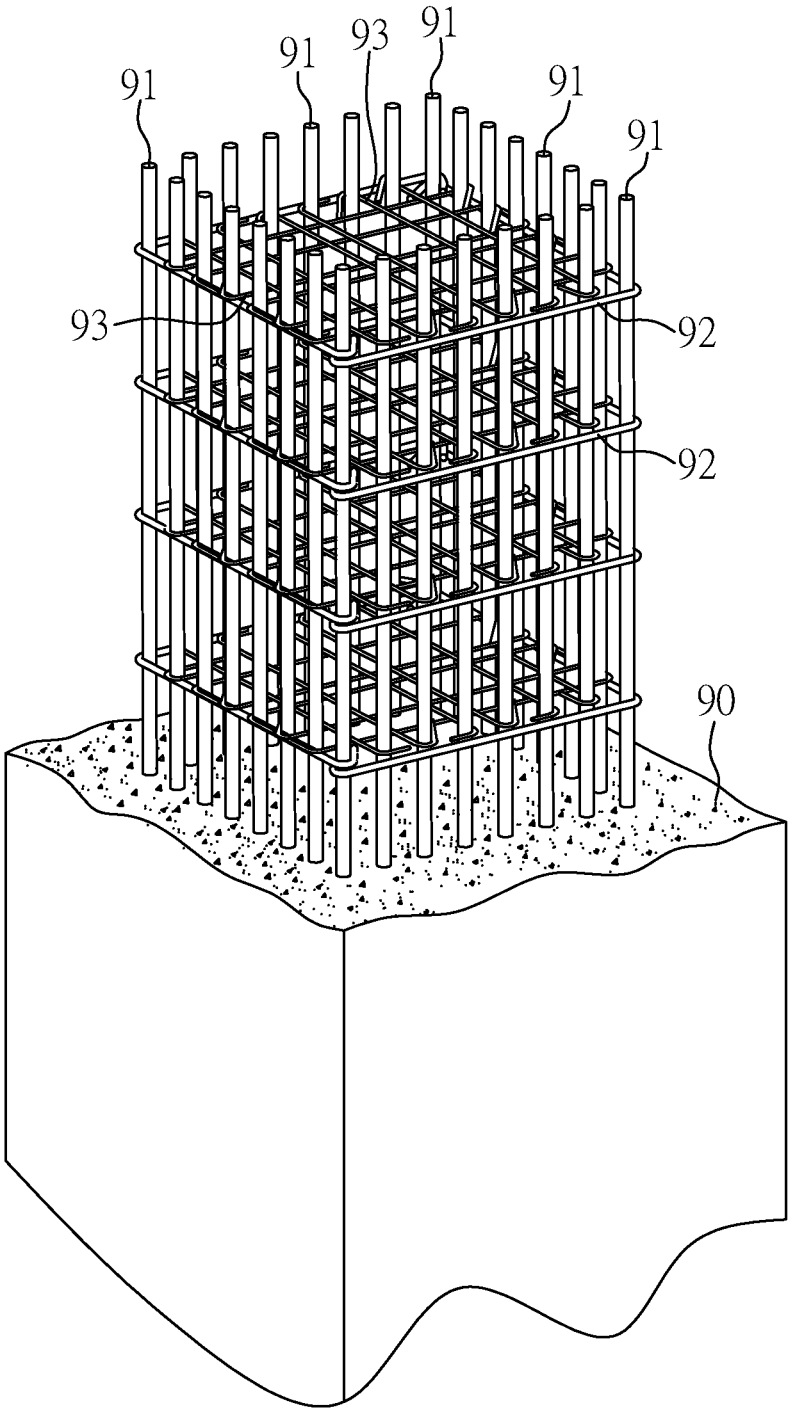
FIG. 1 (PRIOR ART)
FIG. 1 is a perspective view illustrating a conventional combined structure of main steel bars, stirrups and tie bars.
Figure 2:
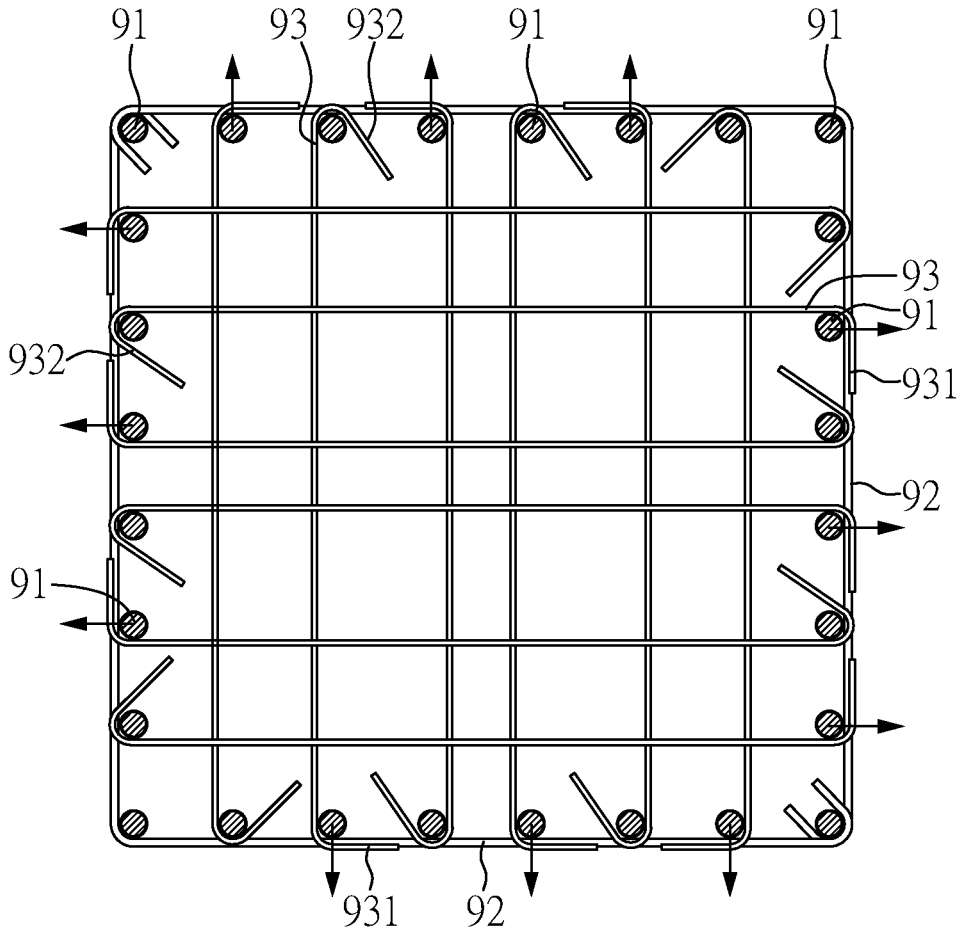
FIG. 2 (PRIOR ART)
FIG. 2 is a plan view illustrating the conventional combined structure of main steel bars, stirrups and tie bars, as shown in FIG. 1.
Figure 3:
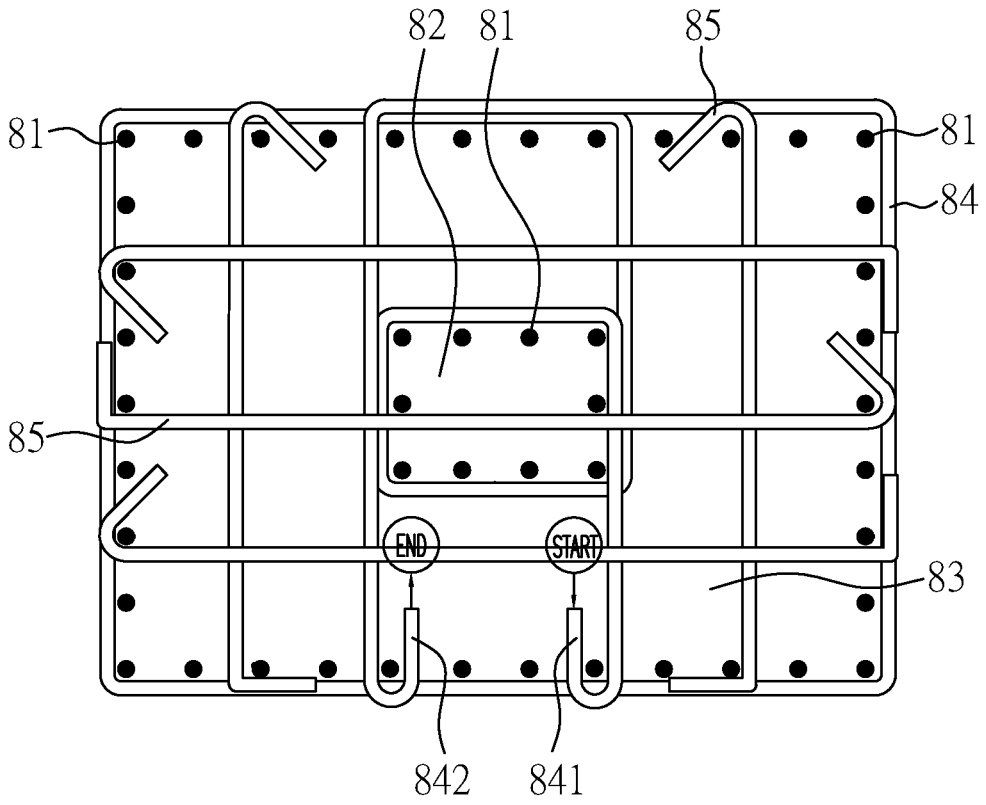
FIG. 3 (PRIOR ART)
FIG. 3 is a plan view illustrating the conventional combined structure of main steel bars, stirrups and tie bars in a dual-core seismic resistance columns.
Figure 4A:
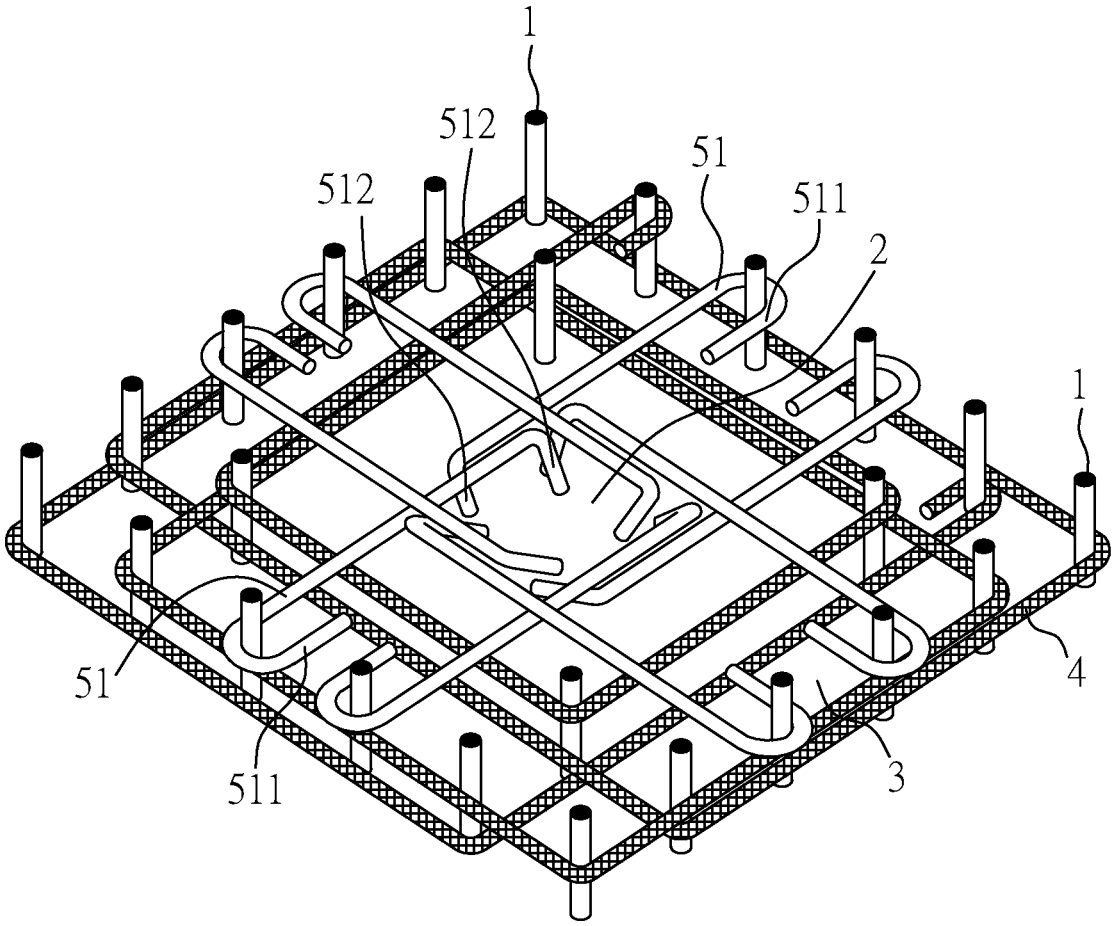
FIG. 4A is a perspective view illustrating a combined structure in a column according to a first embodiment of the present invention.
Figure 4B:
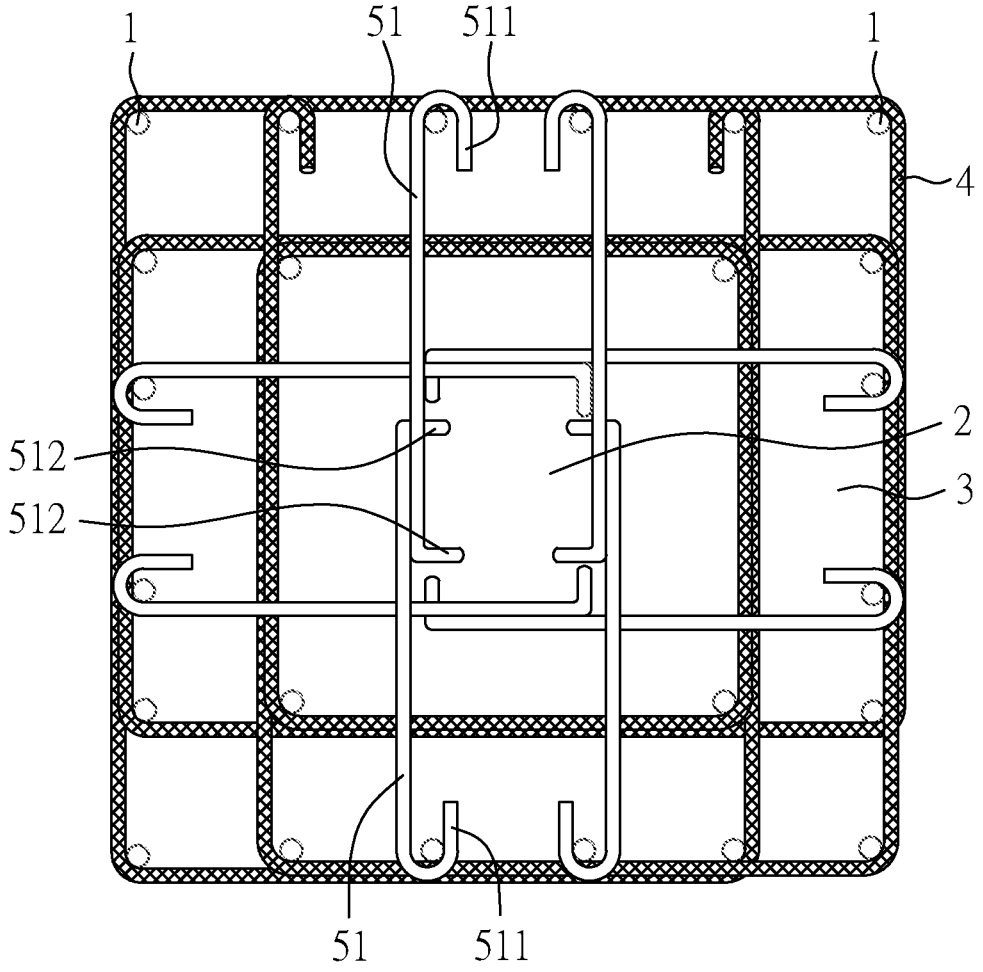
FIG. 4B is a plan view illustrating the combined structure in a column according to the first embodiment of the present invention.

References are made to FIG. 4A, a perspective view illustrating a combined structure in a column according to a first embodiment of the present invention; and FIG. 4B, a plan view illustrating the combined structure in a column. In the first embodiment, the combined structure in a column comprises a plurality of main steel bars 1, a consecutive stirrup 4, and a plurality of tie bars 51. The plural main steel bars 1 are arrayed to form an inner confined region 2 and an outer confined region 3 surrounding the inner confined region 2. Further, the consecutive stirrup 4 proceeds with a consecutive turning and surrounding along the inner confined region 2 and the outer confined region 3. The consecutive stirrup 4 surrounds every main steel bar 1, and surrounds a region in the consecutive stirrup 4 of the inner confined region 2 so as to form a column core, wherein the consecutive stirrup 4 and the plural main steel bars 1 are tied up together by winding plural metal wire. The plural tie bars 51 are each connected in between the plural main steel bars 1 in the inner confined region 2 and the outer confined region 3. The tie bars 51 each include a first end 511 and a second end 512, where the first end 511 hooks one of the plural main steel bars 511, which lacks lateral support, in the outer confined region 3, while the second end 512 anchors in the column core, where the column core refers to the region formed by the consecutive stirrup 4 surrounding the inner confined region 2.

In the first embodiment, the first ends 511 of the tie bars 51, which hook the main steel bars 511 in the outer confined region 3, are each formed as a hook of about 180°. The second ends 512 of the tie bars 51, which anchor in the inner confined region 2, are each formed as a hook of about 90°. The two tie bars 51, which anchor in the inner confined region 2, are arranged in a manner of overlapping joining. Further, both the inner confined region 2 and the outer confined region 3 are in the form of square; or both are in the form of rectangle; or one of them is of square while the other is of rectangle.

Figure 5:
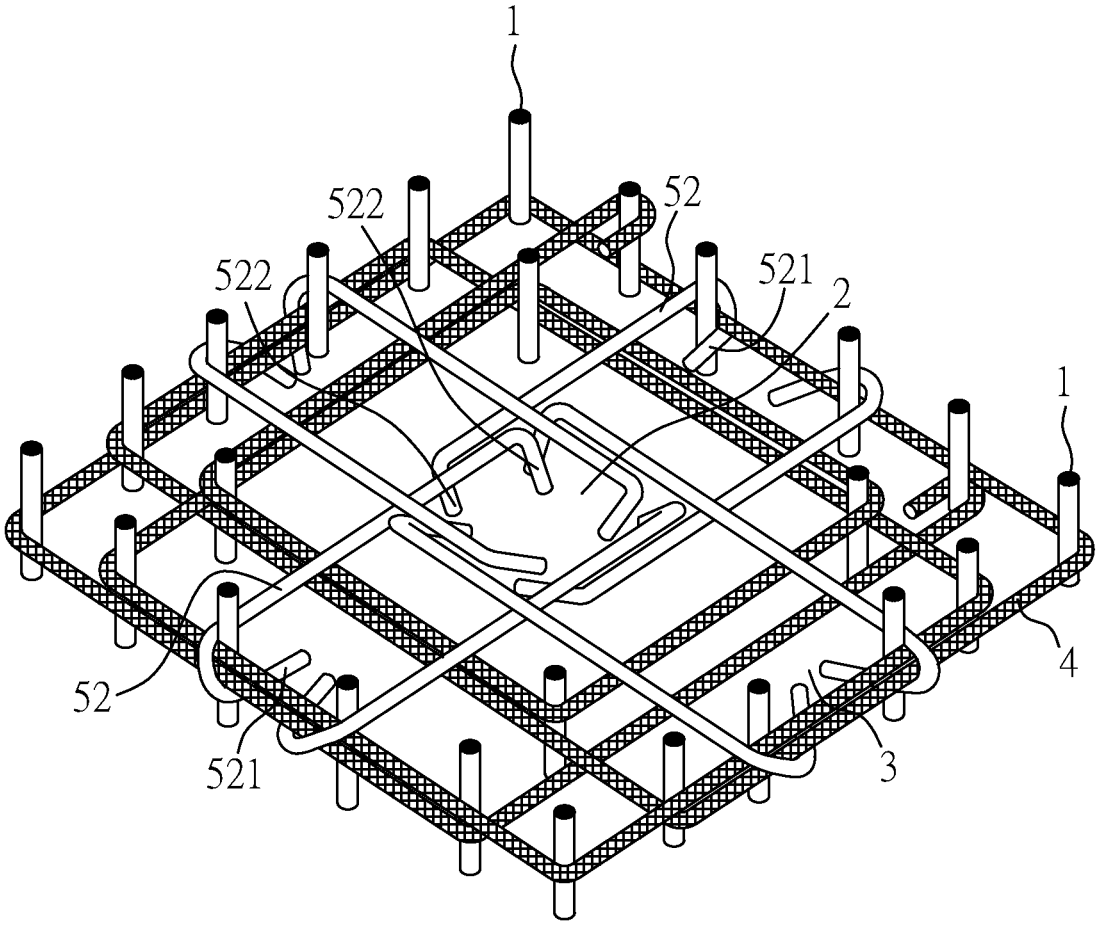
FIG. 5 is a perspective view illustrating a combined structure in a column according to a second embodiment of the present invention.

Further, a reference is made to FIG. 5, a perspective view illustrating a combined structure in a column according to a second embodiment of the present invention; and also to FIG. 4A. The combined structure of the second embodiment is substantially similar to that of the first embodiment, except that in the second embodiment, the first end 521 of a tie bar 52 in the outer confined region 3 hooks, in the meantime, one of the plural main steel bars 1 and the consecutive stirrup 4 in the outer confined region 3; whereas in the first embodiment, the first end 511 of the tie bar 51 hooks directly and horizontally one of the plural main steel bars 1 in the outer confined region 3. However, in the second embodiment, the second end 522 of the tie bar 52, which anchors in the inner confined region 2, is formed as about 90°, and the two tie bars 52, which anchor in the inner confined region 2, are arranged in a manner of overlapping joining. In this respect, the second embodiment is identical with the first embodiment.

Figure 6:
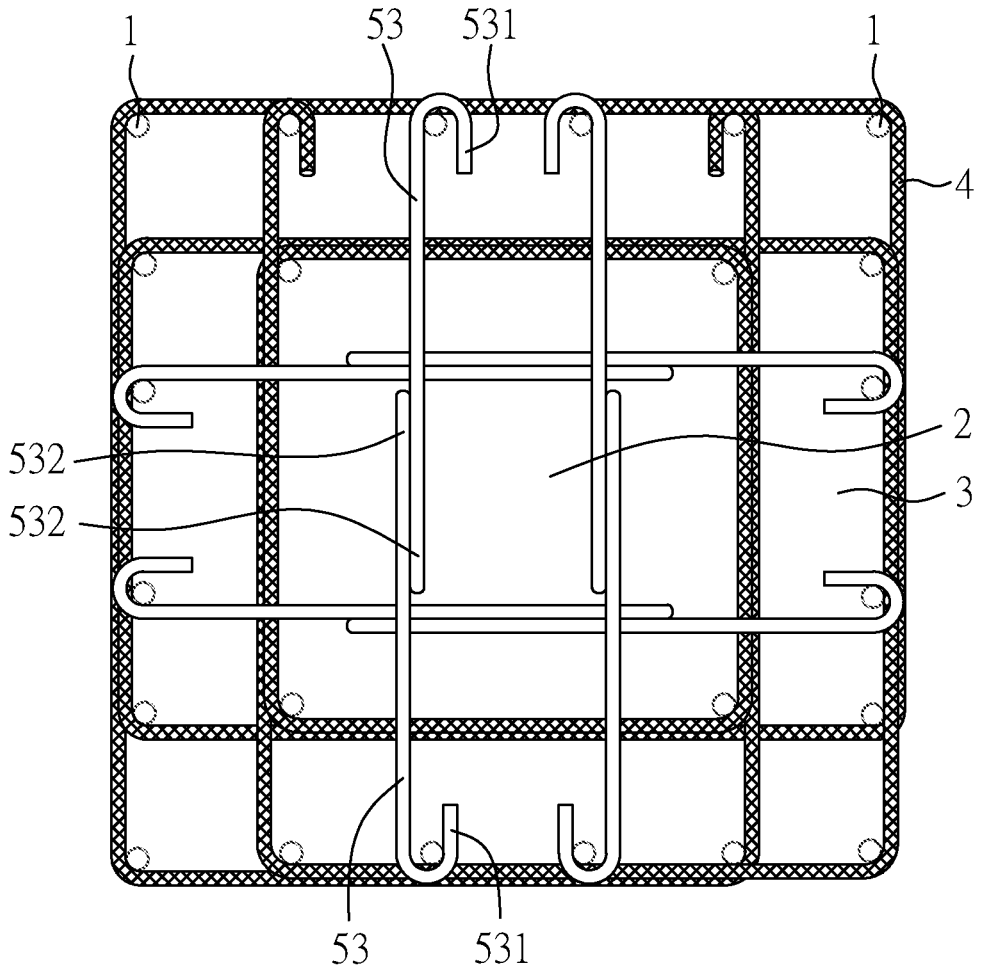
FIG. 6 is a plan view illustrating a combined structure in a column according to a third embodiment of the present invention.

Still further, references are made to FIG. 6, a plan view illustrating a combined structure in a column according to a third embodiment of the present invention; and FIG. 4B. The combined structure of the third embodiment is substantially similar to that of the first embodiment, except that in the third embodiment, the second end 532 of a tie bar 53 in the inner confined region 2 is formed linearly without a hook; whereas in the first embodiment, the second end 512 of the tie bar 51 is formed as a hook and about 90°. However, in the third embodiment, a first end 531 of the tie bar 53, which anchors in the inner confined region 2, is formed as about 180°. In this respect, the third embodiment is identical with the first embodiment.

Figure 7:
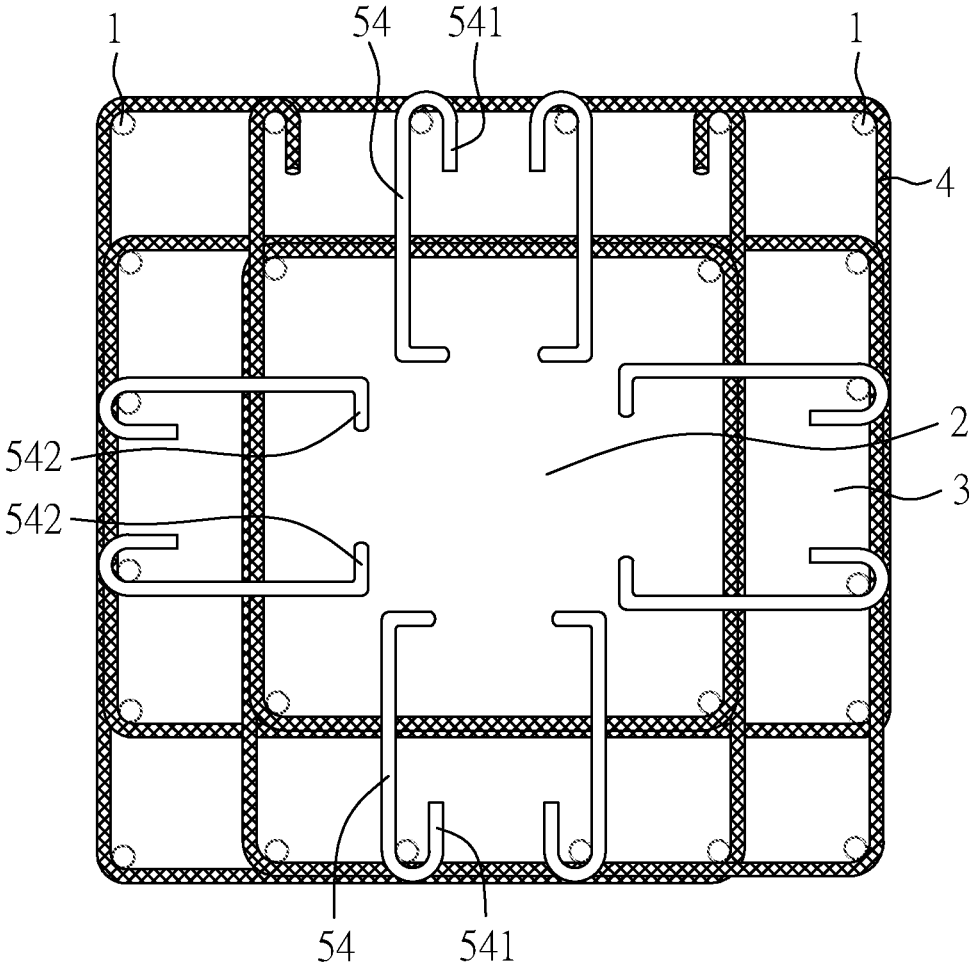
FIG. 7 is a plan view illustrating a combined structure in a column according to a fourth embodiment of the present invention.

Now referring to FIG. 7, and also to FIG. 4B, the fourth embodiment is substantially similar to the first embodiment in terms of structure. However, the fourth embodiment is different from the first embodiment in that in the fourth embodiment, two tie bars 54 anchor in the inner confined region 2 are not overlapped with each other; whereas in the first embodiment, the two tie bars 52, which anchor in the inner confined region 2, are arranged in a manner of overlapping joining. However, in the fourth embodiment, the first end 541 of a tie bar 54, which hooks a main steel bar 1 in the outer confined region 3, is formed as about 180°, and a second end 542 of the tie bar 54, which anchor in the inner confined region 2, is formed as a hook of about 90°. In this respect, the fourth embodiment is identical with the first embodiment.

Figure 8:
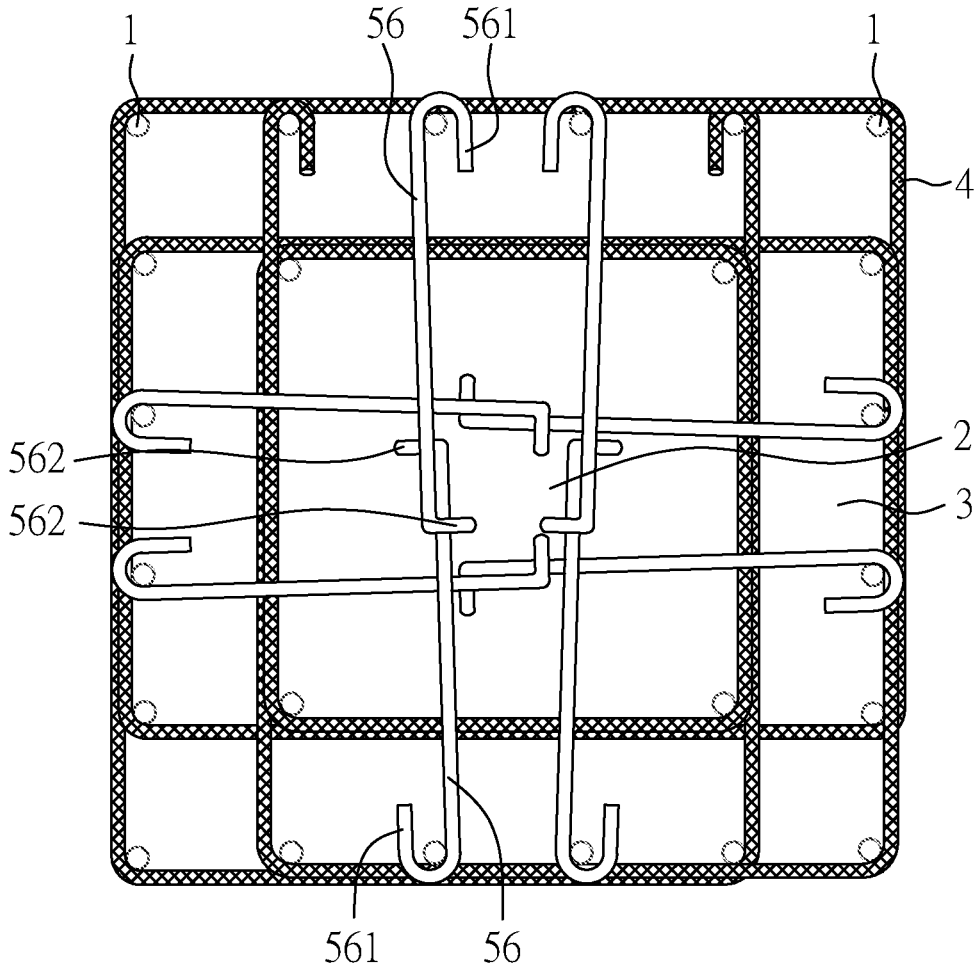
FIG. 8 is a plan view illustrating a combined structure in a column according to a fifth embodiment of the present invention.

A reference is made to FIG. 8, a plan view illustrating a combined structure in a column according to a fifth embodiment of the present invention; and also to FIG. 4B. The combined structure of the fifth embodiment is substantially similar to that of the first embodiment, except that in the fifth embodiment, the first end 561 of a tie bar 56 hooking the main steel bar 1 of the outer confined region 3 is arranged in a different direction with a first end 561 of the tie bar 56 hooking a main steel bar 1 at opposite side of the outer confined region 3, namely the two tie bars 56 have their first ends 561, formed as hooks about 180°, located leftward and rightward. However, in the first embodiment, the first end 511 of the tie bar 51 hooking the main steel bar 1 of the outer confined region 3 is arranged in the same direction with the first end 511 of the tie bar 51 hooking the main steel bar 1 at opposite side of the outer confined region 3. A second end 562 of the tie bar 56, which anchors in the inner confined region 2, is formed as about 90°, and the two tie bars 56, which anchor in the inner confined region 2, are arranged in a manner of overlapping joining. In this respect, the fifth embodiment is identical with the first embodiment.

Figure 9:
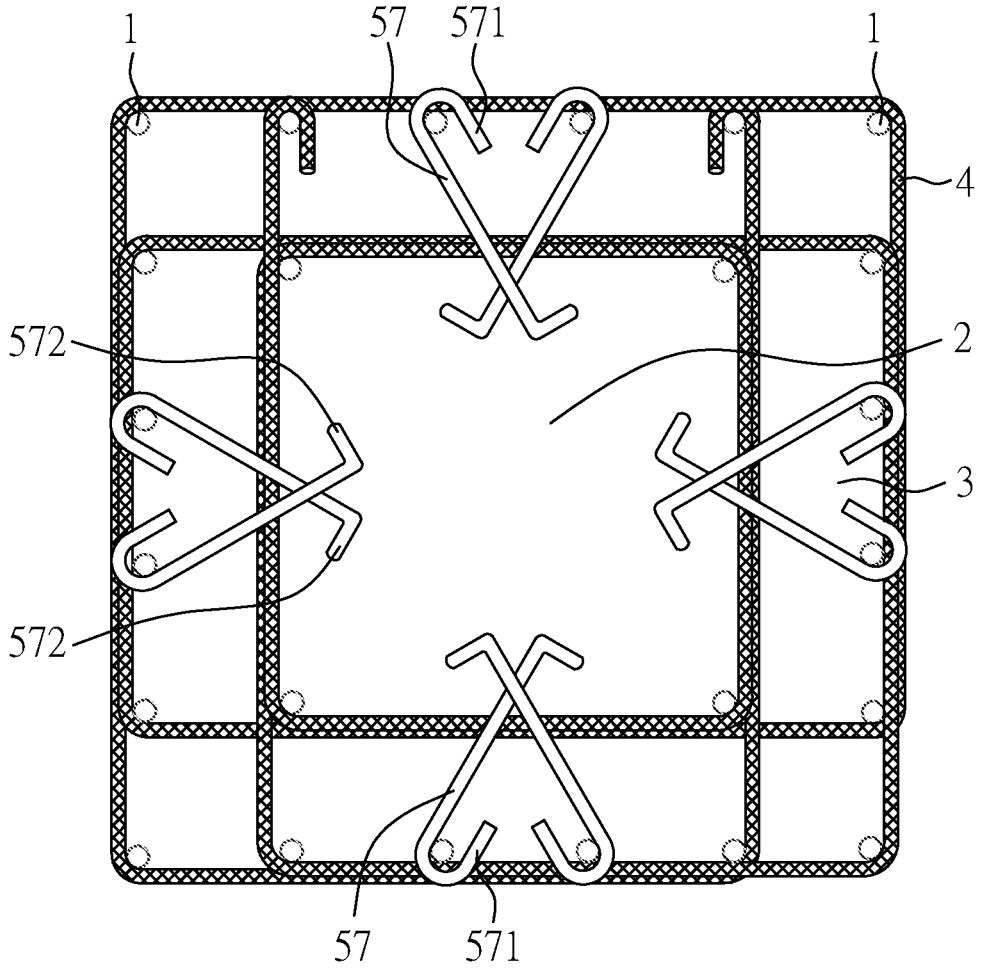
FIG. 9 is a plan view illustrating a combined structure in a column according to a sixth embodiment of the present invention.

Further, a reference is made to FIG. 9, a plan view illustrating a combined structure in a column according to a sixth embodiment of the present invention; and also to FIG. 4B. The combined structure of the sixth embodiment is substantially similar to that of the fourth embodiment, except that in the sixth embodiment, the tie bars 57 hooking the plural main steel bars 1 of the outer confined region 3 are arranged in a manner non-vertical to the consecutive stirrup 4. However, in the fourth embodiment, the tie bars 54 hooking the main steel bars 1 of the outer confined region 3 are vertical to the consecutive stirrup 4. In the sixth embodiment, a first end 571 of the tie bar 57 hooking the main steel bar 1 of the outer confined region 3 is formed as a hook about 180°; whereas a second end 572 of the tie bar 57 anchoring in the inner confined region 2 is formed as a hook about 90°. In this respect, the sixth embodiment is identical with the fourth embodiment.

Figure 10A:
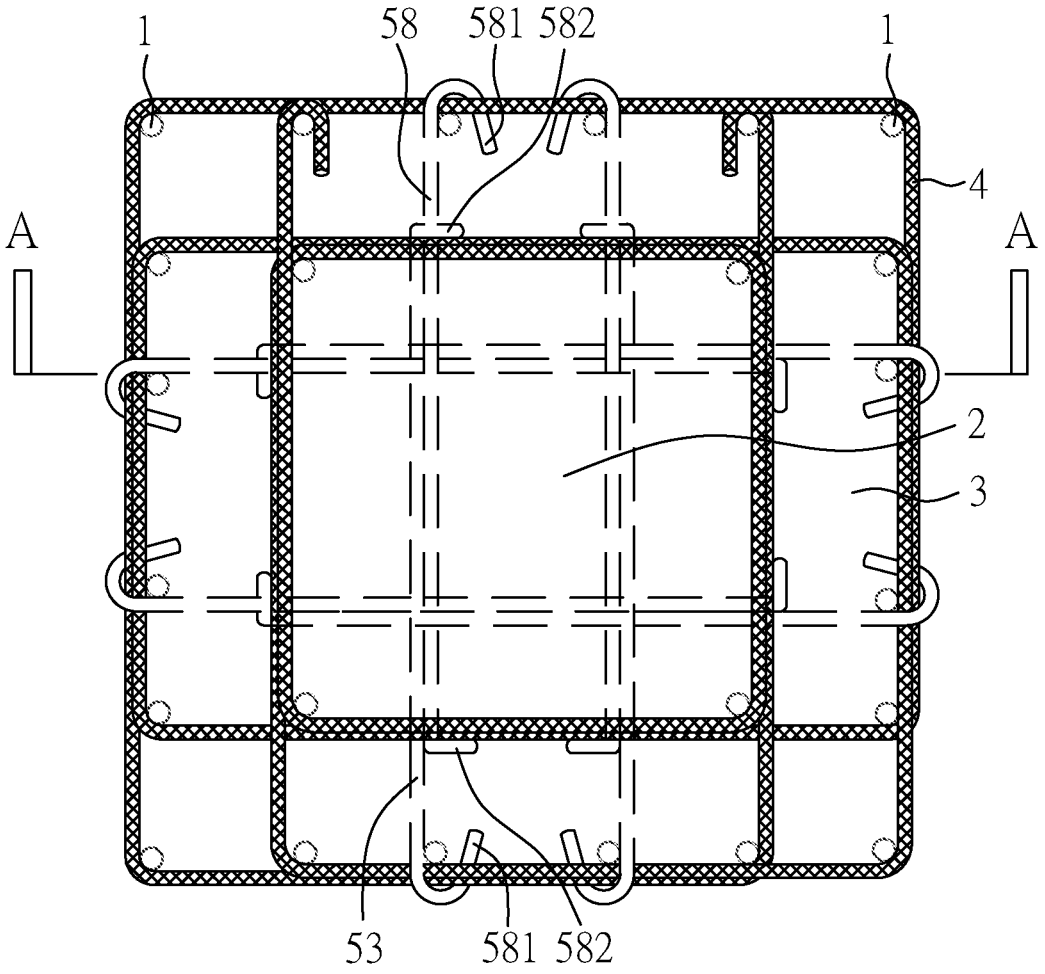
FIG. 10A is a plan view illustrating a combined structure in a column according to a seventh embodiment of the present invention.
Figure 10B:
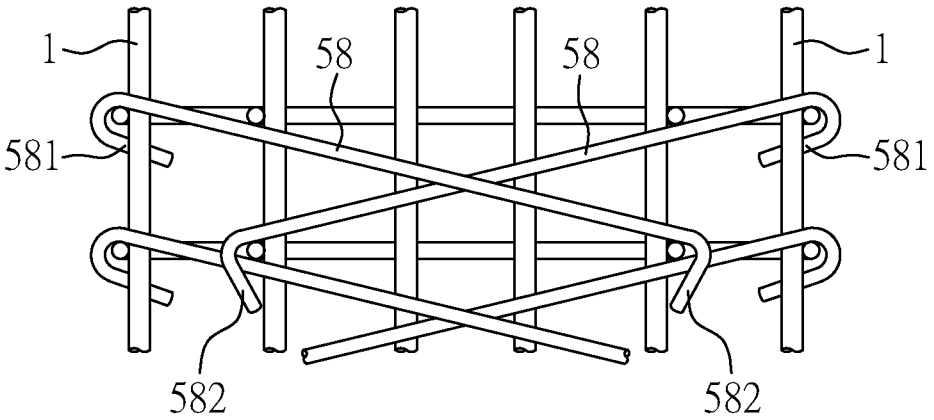
FIG. 10B is a cross-sectional view illustrating the combined structure in a column along cutting line A-A of FIG. 10A according to the seventh embodiment of the present invention.

Still further, references are made to FIG. 10A, a plan view illustrating a combined structure in a column according to a seventh embodiment of the present invention; and FIG. 10B, a cross-sectional view illustrating the combined structure in a column along cutting line A-A of FIG. 10A; and FIG. 4B. The combined structure of the seventh embodiment is substantially similar to that of the first embodiment, except that in the seventh embodiment, the second end 582 of a tie bar 58 anchors the consecutive stirrup 4 in the inner confined region 2; whereas in the first embodiment, the second end 512 of the tie bar 51 anchors in the column core of the inner confined region 2. Besides, in the seventh embodiment, a first end 581 of the tie bar 58 hooks, in the meantime, the plural main steel bars 1 and the consecutive stirrup 4; whereas in the first embodiment, the first end 511 of the tie bar 51 hooks directly and horizontally one of the plural main steel bars 1 of the outer confined region 3. Further, in the seventh embodiment, the first end 581 of the tie bar 58 is formed as a hook about 180°, while the second end 582 of the tie bar 58 is formed as a hook about 90°. In this respect, the seventh embodiment is identical with the first embodiment.

Given the above, it is understood that all the embodiments, as mentioned above, not only can effectively enhance axial tension and pressure intensity of the column core, but also can provide a complete confinement for the main steel bars, so as to effectively prevent the main steel bars from buckling, and to decrease the decay of the strength and stiffness of the columns as subject to great axial force and repeated displacement, such that the performance of seismic resistance for the columns can be enhanced. Besides, in all the above-mentioned embodiments, the tie bars can be arranged, in a manner of overlapping joining or non-overlapping joining, in the combined structure in a column, or arranged in various angles in the combined structure in a column. This not only makes the construction easier, but also increases flexibility of arrangement without being adversely affected by the deviation of main steel bars at the site.

Although the present invention has been explained in relation to its preferred embodiments, it is to be understood that many other possible modifications and variations can be made without departing from the scope of the invention as hereinafter claimed.

What is claimed is:

1. A combined structure, comprising:

a plurality of main steel bars, arrayed to form an inner confined region and an outer confined region surrounding the inner confined region;

a consecutive stirrup, surrounding along the inner confined region and the outer confined region with a consecutive turning, and surrounding a region of the consecutive stirrup in the inner confined region so as to form a column core; and a plurality of tie bars, each connected in between the plurality of main steel bars in the inner confined region and the outer confined region, the plurality of tie bars each including a first end and a second end, wherein the first end hooks one of the plurality of main steel bars, which lacks lateral support, in the outer confined region, while the second end anchors in the column core.

2. The combined structure as claimed in claim 1, wherein each of the plurality of tie bars hooking the outer confined region has its first end formed as a hook greater than 135°.

3. The combined structure as claimed in claim 1, wherein each of the plurality of tie bars anchored in the column core has its second end formed as a hook of any angle, or formed linearly without a hook.

4. The combined structure as claimed in claim 1, wherein each of the plurality of tie bars anchored in the column core has its second end anchored on the consecutive stirrup.

5. The combined structure as claimed in claim 1, wherein the consecutive stirrup surrounds every main steel bar.

6. The combined structure as claimed in claim 1, wherein the plurality of tie bars each hooking the outer confined region have their first end tie up one of the plurality of main steel bars and the consecutive stirrup by a winding manner.

7. The combined structure as claimed in claim 1, wherein two of the plurality of tie bars have their first ends connected with, respectively at two opposite sides, two of the plurality of main steel bars; and the two of the plurality of tie bars anchored in the column core have their second ends arranged, respectively, in a manner of overlapping joining or non-overlapping joining.

8. The combined structure as claimed in claim 1, wherein two of the plurality of tie bars anchored in the column core have their second ends arranged with hooks of any angle or arranged linearly without hooks.

9. The combined structure as claimed in claim 1, wherein the plurality of tie bars, on a plane, are anchored in the column core in a non-vertical manner to the consecutive stirrup.

10. The combined structure as claimed in claim 1, wherein two of the plurality of tie bars have their second ends vertically and inclinedly anchored in the column core.

* * * * *